US008261638B2

(12) United States Patent
Hsu

(10) Patent No.: US 8,261,638 B2
(45) Date of Patent: Sep. 11, 2012

(54) HAND TOOL ADAPTER

(76) Inventor: Chang Hsueh-O Hsu, Taichung (TW)

( * ) Notice: Subject to any disclaimer, the term of this patent is extended or adjusted under 35 U.S.C. 154(b) by 331 days.

(21) Appl. No.: 12/756,864

(22) Filed: Apr. 8, 2010

(65) Prior Publication Data

US 2011/0247464 A1 Oct. 13, 2011

(51) Int. Cl.
*B25B 13/06* (2006.01)
*B25B 23/16* (2006.01)
*B25G 1/10* (2006.01)

(52) U.S. Cl. ..... 81/124.4; 81/177.2

(58) Field of Classification Search ..... 81/124.4–124.7, 81/125.1, 177.2; D8/29
See application file for complete search history.

(56) References Cited

U.S. PATENT DOCUMENTS 226,582 A * 4/1880 Miller ..... 81/124.4
D53,597 S * 7/1919 Marcmann ..... D8/28
D103,579 S * 3/1937 McNaught ..... D8/28
4,056,020 A * 11/1977 Coviello ..... 81/177.2
4,727,782 A * 3/1988 Yang ..... 81/124.4
6,029,547 A * 2/2000 Eggert et al. ..... 81/124.6
6,257,107 B1 * 7/2001 Chang et al. ..... 81/467
6,286,395 B1 * 9/2001 Frazier ..... 81/60
6,314,841 B1 * 11/2001 Burk et al. ..... 81/125.1
6,382,054 B1 * 5/2002 Kirk ..... 81/124.4
6,408,723 B1 * 6/2002 Zurbuchen ..... 81/119
6,962,098 B2 * 11/2005 Eggert et al. ..... 81/124.6
7,305,907 B2 * 12/2007 Burwell ..... 81/60
2002/0011136 A1 * 1/2002 Eggert et al. ..... 81/125.1
2004/0099102 A1 * 5/2004 Vaughan ..... 81/124.4
2004/0177733 A1 * 9/2004 Peters ..... 81/490
2005/0261784 A1 * 11/2005 Erb ..... 623/65
2010/0011915 A1 * 1/2010 Badger ..... 81/60

* cited by examiner

*Primary Examiner* — David B Thomas

(57) ABSTRACT

A hand tool adapter of the present invention includes a plastic main body and at least six metallic sockets. The main body is formed with at least six holes, and the sockets are fixedly received in the holes respectively. Each socket has a non-circular bore whose axial vector is different those of the bores of the other sockets. Further, each bore has a dimension different from those of the other bores.

9 Claims, 9 Drawing Sheets

HAND TOOL ADAPTER

BACKGROUND OF THE INVENTION

1. Field of the Invention

The present invention relates to a hand tool adapter.

2. Description of the Prior Art

As disclosed in TW M257924 and TW 437519, a conventional hand tool can drive a screw or a nut to rotate for fastening purposes. Another hand tool as disclosed in TW M361408 provides a ratchet mechanism whose axis can be adjusted. However, the driving portion thereof has fixed dimension. Thus it requires several hand tools in order to drive workpieces with different dimensions. Accordingly, adapters are arisen to mitigate such disadvantages. Nevertheless, it still requires several adapters in order to correspond to workpieces with different dimensions.

SUMMARY OF THE INVENTION

The main object of the present invention is to provide an adapter which can correspond to workpieces with different dimensions.

To achieve the above and other objects, a hand tool adapter of the present invention includes a plastic main body and at least six metallic sockets. The main body is formed with at least six holes, and the sockets are fixedly received in the holes respectively. Each socket has a non-circular bore whose axial vector is different those of the bores of the other sockets. Further, each bore has a dimension different from those of the other bores.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
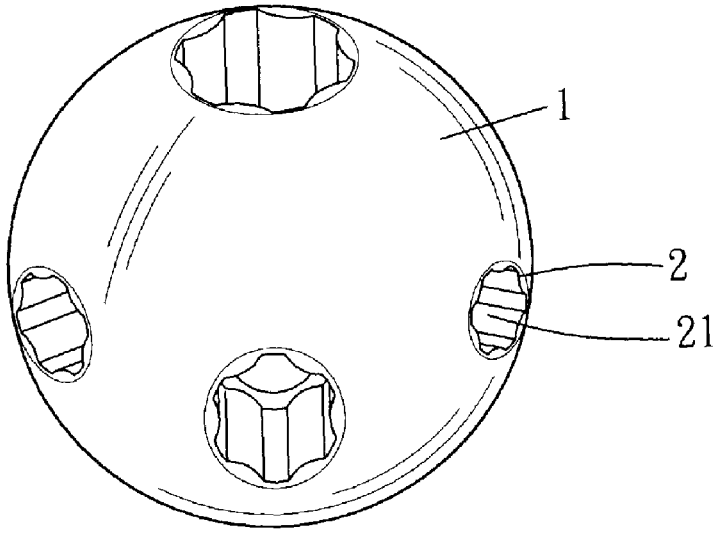
FIG. 1 is a perspective drawing showing an adapter of the present invention.
Figure 2:
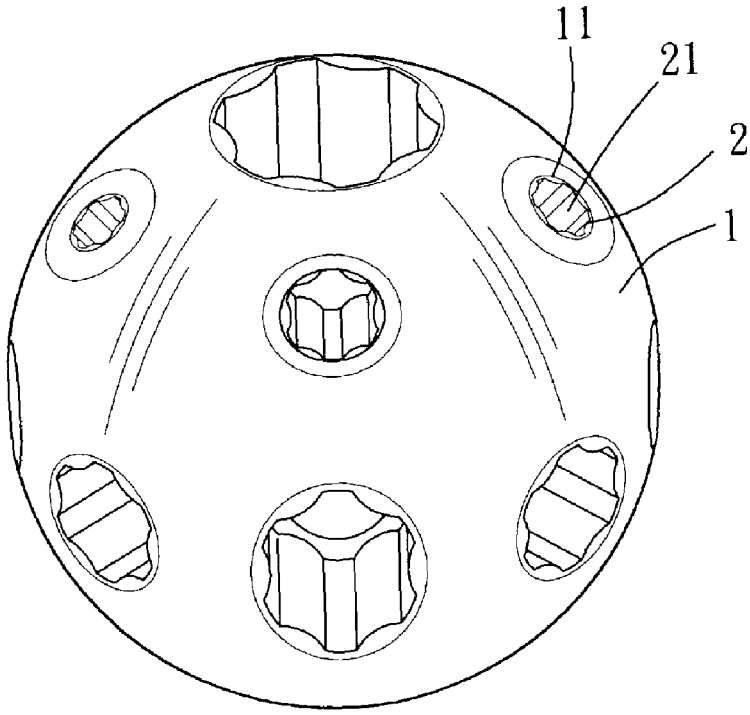
FIG. 2 is a perspective drawing showing another adapter of the present invention.

Please refer to FIG. 1 and FIG. 2. A hand tool adapter of the present invention includes a main body 1 and six or more than six sockets 2.

Figure 3:
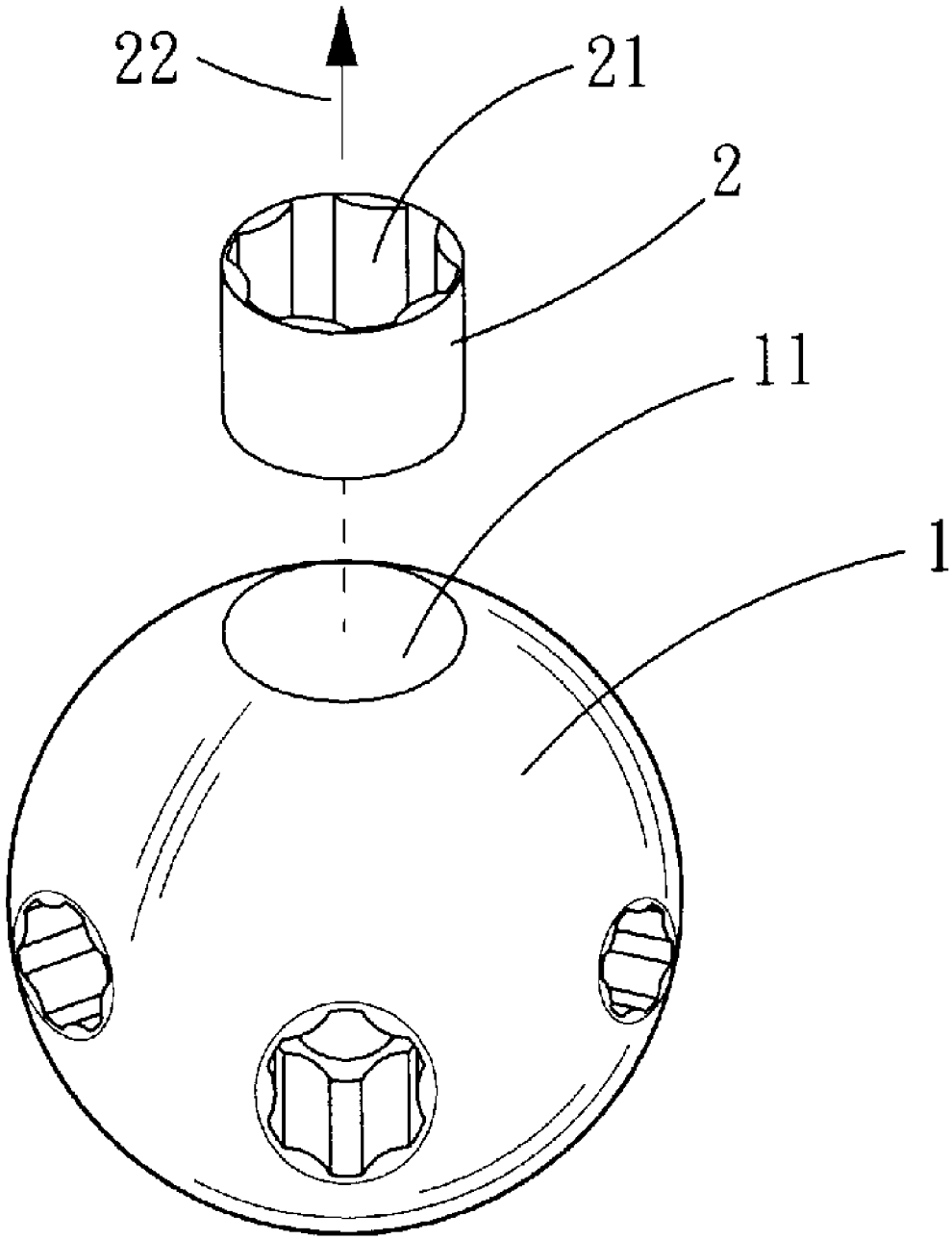
FIG. 3 is a breakdown drawing showing an adapter of the present invention.
Figure 4:
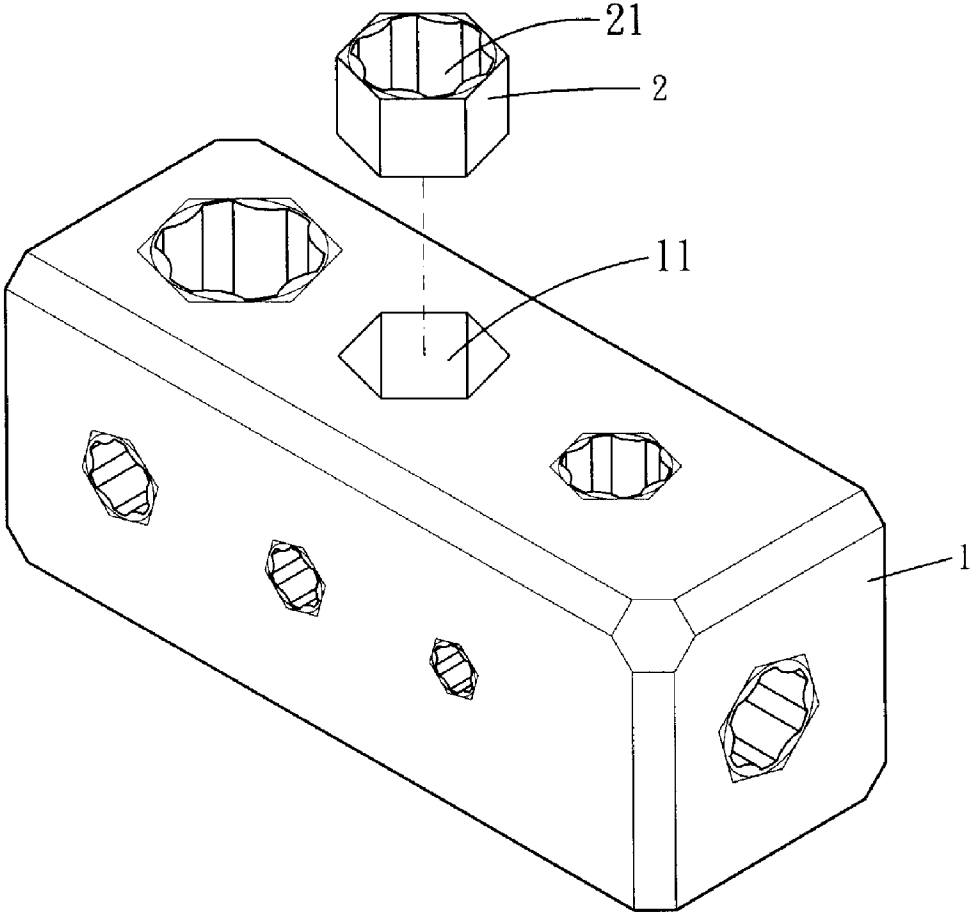
FIG. 4 is a perspective drawing showing yet another adapter of the present invention.
Figure 5:
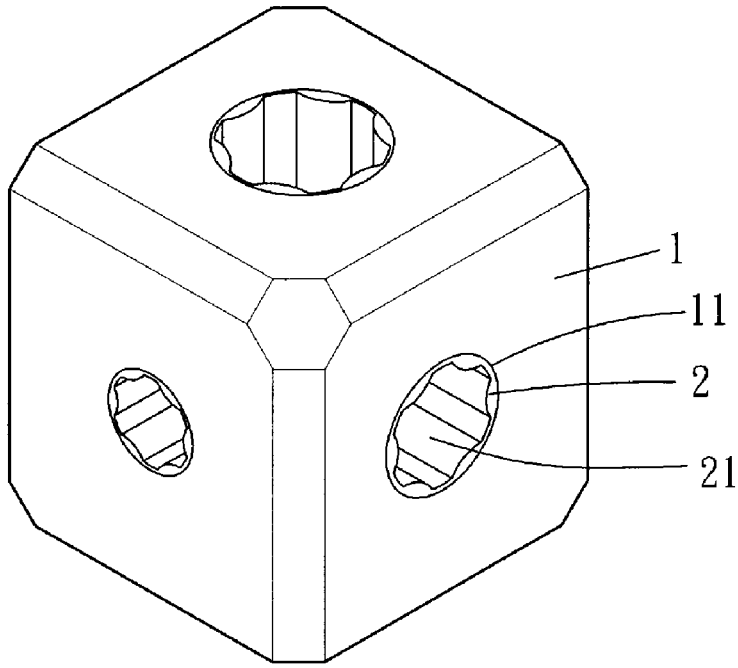
FIG. 5 is a perspective drawing showing yet another adapter of the present invention.
Figure 6:
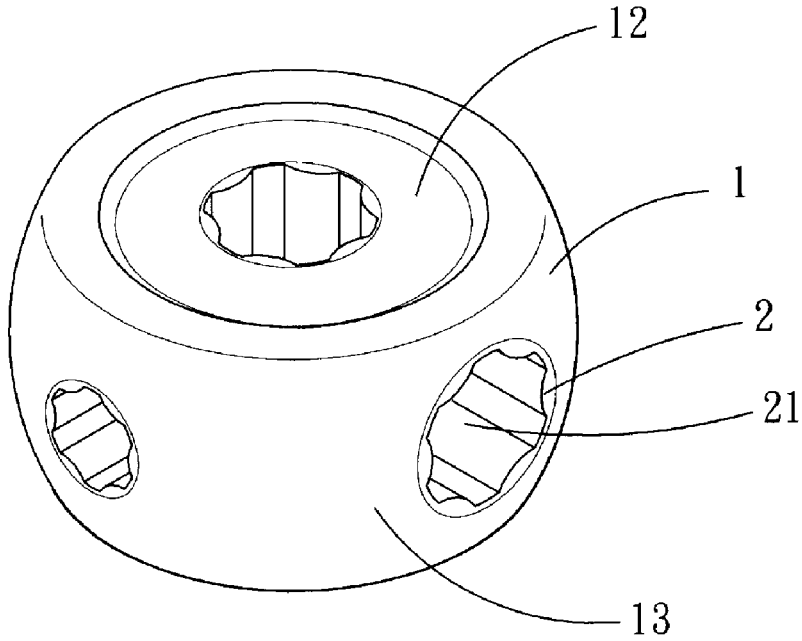
FIG. 6 is a perspective drawing showing yet another adapter of the present invention.

Please refer to FIG. 3. The main body 1 is made from plastic, and preferably from glass-fiber-reinforced plastic. The main body 1 is formed with at least six holes 11. The cross sections of the holes 11 may be rounded or non-circular, e.g. hexagonal as shown in FIG. 4. The main body 1 itself may be ball-shaped, cuboid or cubic as shown in FIG. 5. Thus the main body 1 has six surfaces, each of which is formed with at least one hole 11. As shown in FIG. 6, the main body 1 may also be a cylinder and thus has a top surface 12, a bottom surface and an annular side surface 13. The top surface 12 is formed with one of the hole, the bottom surface is formed with another hole, and the side surface 13 is formed with the other four holes.

Figure 7:
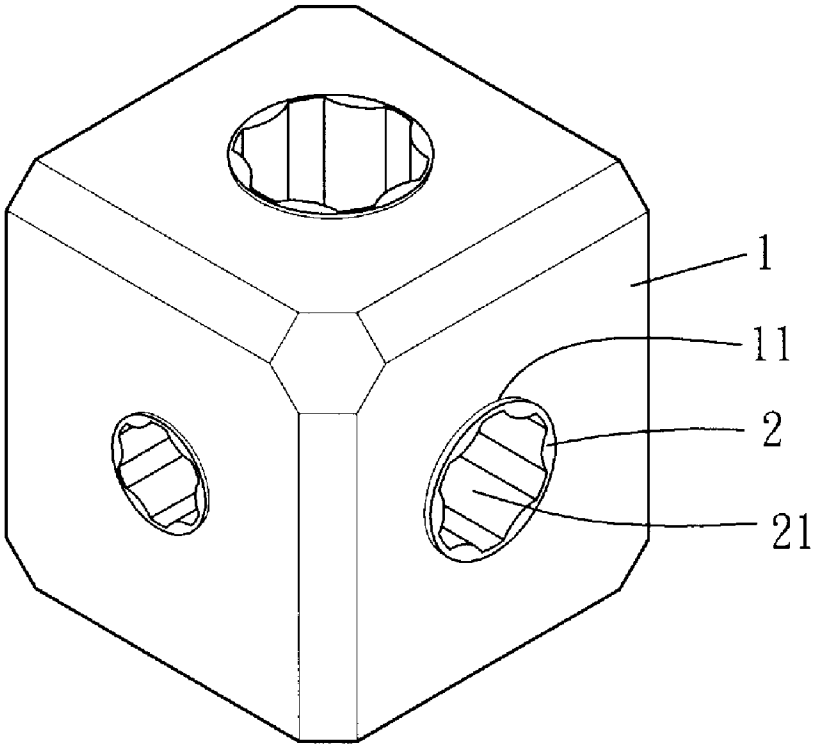
FIG. 7 is a perspective drawing showing yet another adapter of the present invention.

The sockets 2 are made of metallic material to have better mechanical strength. Each socket 2 has a contour corresponding to the cross section of its corresponding hole 11 so that the socket 2 can be fixedly received therein. Each socket 2 defines a non-circular bore 21, which has an axial vector 22 going from the inside of the main body 1 toward the outside of the main body 1. The axial vectors 22 of the bores 21 are different from one another. Furthermore, each bore 21 has a dimension different from those of the other bores 21. In the present embodiment, every two opposite bores 21 are coaxial. The sockets 2 may flush with their corresponding surfaces of the main body 1, or they may also be slightly protrusive from the surfaces as shown in FIG. 7, i.e. each hole has a depth smaller than an axial length of its corresponding socket.

Figure 8:
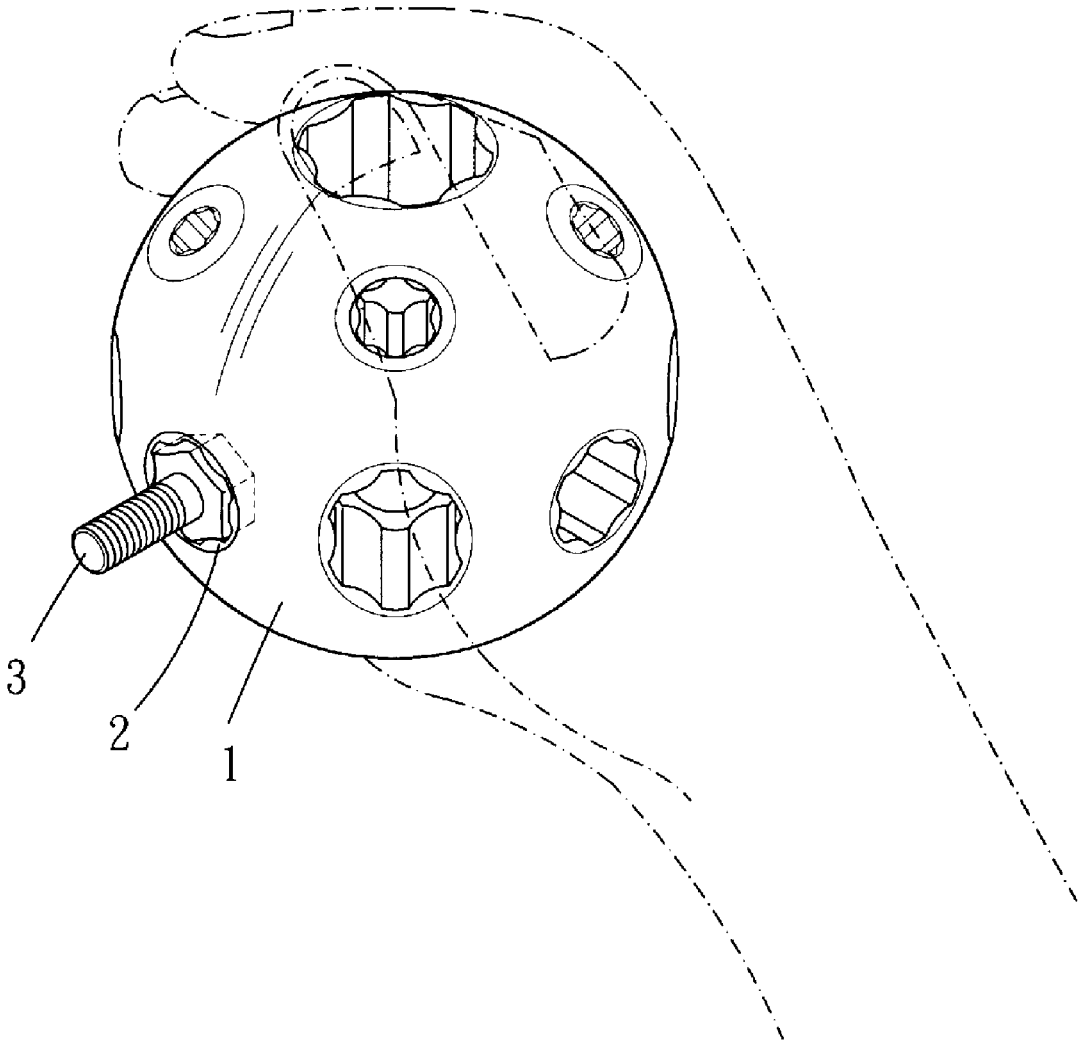
FIG. 8 is a drawing showing a user using an adapter of the present invention.
Figure 9:
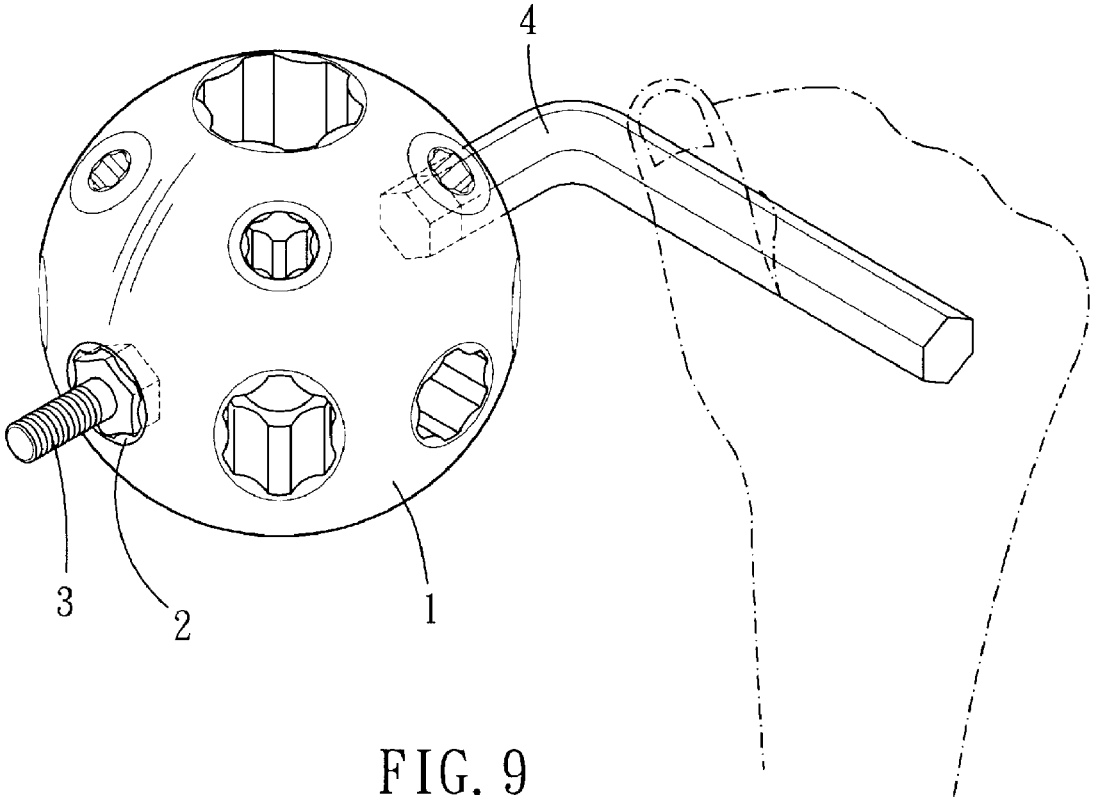
FIG. 9 is a drawing showing a user using an adapter of the present invention.

Please refer to FIG. 8. The adapter can be directly used to drive a screw 3 or the like. More specifically, the screw 3 is engaged with one of the sockets 2, and the user turns the main body 1 with his/her bare hand so that the screw 3 can be turned simultaneously. Please refer to FIG. 9. Another hand tool 4 can be used to connect to another socket, thus the user can drive the main body 1 to rotate with the hand tool 4.

Figure 10:
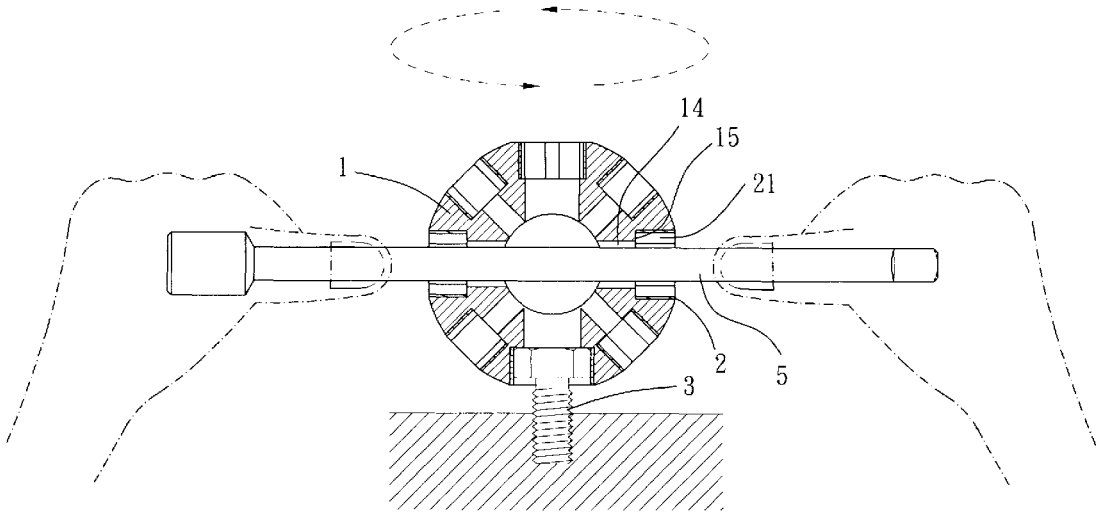
FIG. 10 is a drawing showing a user using an adapter of the present invention.
Figure 11:
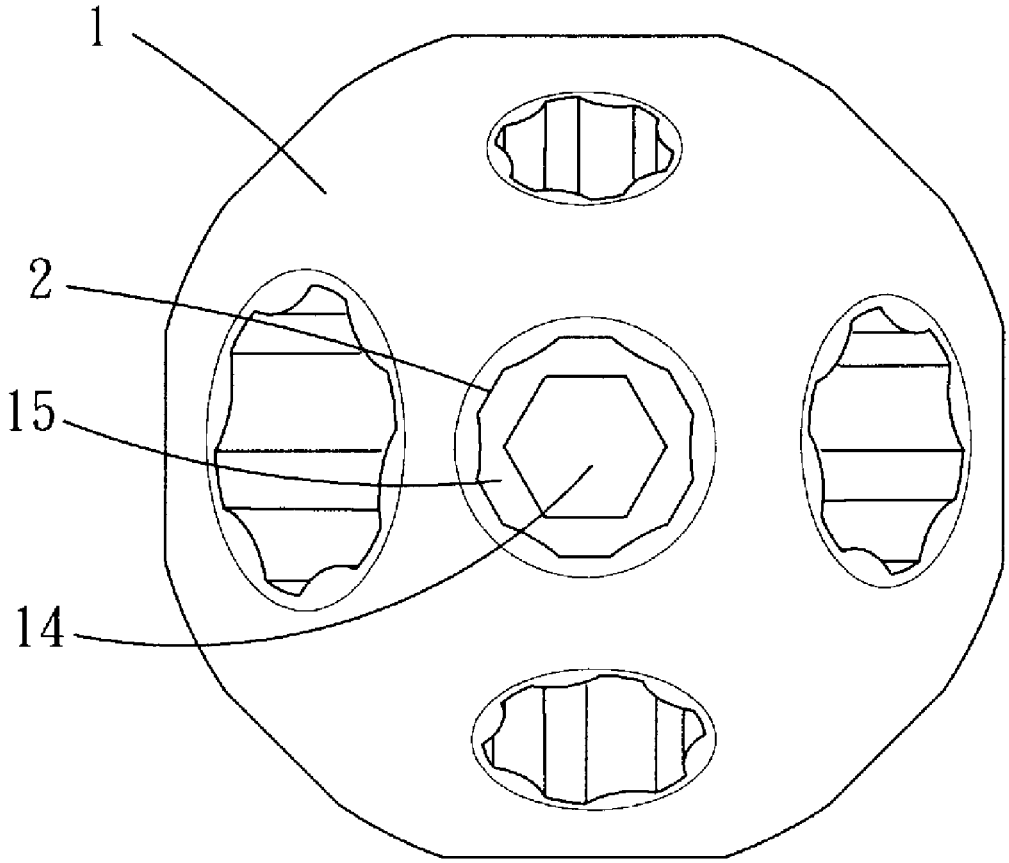
FIG. 11 is a drawing showing an adapter with a non-circular through hole of the present invention.

Please refer to FIG. 10. The main body 1 has at least one through hole 14 connecting two opposite coaxial holes, and then the through hole 14 can communicate with the bores 21 of the sockets 2 received in the two opposite holes. Further, the through hole 14 may have a non-circular cross section as shown in FIG. 11. As such, a rod 5 can be used to insert through the through hole 14 and to drive the main body 1 to rotate. Preferably, a dimension of the through hole 14 is smaller than those of the bores 21 of the sockets received in the two opposite holes, so that two step portions 15 are formed between the through hole 14 and the two bores 21. As such, the workpiece 3 received in the bore 21 will not fall into the through hole 14. It is noted that the adapter of the present invention has several sockets for the user to choose from, so as to correspond to workpieces with different dimensions. Further, the user can use the adapter to drive the workpiece bare-handedly or with the help of a hand tool, as disclosed hereinabove.

What is claimed is:

1. A hand tool adapter, comprising a plastic main body, being formed with at least six holes;

at least six metallic sockets, each of which is fixedly received in one of the holes respectively, each socket defining a non-circular bore, each bore having an axial vector, the axial vectors of the bores being different from one another, each bore having a dimension different from those of the other bores, every two opposite bores being coaxial;

wherein the main body has at least one through hole connecting two opposite holes, the through hole communicates with the bores of the sockets received in the two opposite holes.

2. The adapter of claim 1, wherein a dimension of the through hole is smaller than those of the bores of the sockets received in the two opposite holes.

3. The adapter of claim 2, wherein the through hole has a non-circular cross section.

4. The adapter of claim 1, wherein the main body is made from glass-fiber-reinforced plastic.

5. The adapter of claim 1, wherein the main body has a top surface, a bottom surface and an annular side surface, the top surface is formed with one of the holes, the bottom surface is formed with another hole, the side surface is formed with the other holes.

6. The adapter of claim 1, wherein the main body is ball-shaped.

7. The adapter of claim 1, wherein the main body has at least six surfaces, each of which is formed with one of the holes respectively.

8. The adapter of claim 1, wherein a cross section of each hole is non-circular, each socket has a contour corresponding to the cross section of its corresponding hole.

9. The adapter of claim 1, wherein each hole has a depth smaller than an axial length of its corresponding socket.

* * * * *